US009256164B2

(12) United States Patent
Ono et al.

(10) Patent No.: US 9,256,164 B2
(45) Date of Patent: Feb. 9, 2016

(54) DEVELOPMENT ROLLER HAVING MAGNETIC ROLLER AND IMAGE FORMING APPARATUS INCLUDING THE DEVELOPMENT ROLLER

(71) Applicant: Konica Minolta, Inc., Tokyo (JP)

(72) Inventors: Hiroshi Ono, Toyokawa (JP); Toshiki Shima, Sanda (JP)

(73) Assignee: KONICA MINOLTA, INC., Tokyo (JP)

( * ) Notice: Subject to any disclaimer, the term of this patent is extended or adjusted under 35 U.S.C. 154(b) by 108 days.

(21) Appl. No.: 14/070,614

(22) Filed: Nov. 4, 2013

(65) Prior Publication Data

US 2014/0147177 A1 May 29, 2014

(30) Foreign Application Priority Data

Nov. 27, 2012 (JP) ..... 2012-259152

(51) Int. Cl.
*G03G 15/09* (2006.01)

(52) U.S. Cl.
CPC ..... *G03G 15/0928* (2013.01); *G03G 15/0935* (2013.01)

(58) Field of Classification Search
CPC ..... G03G 15/0928; G03G 15/0935
USPC ..... 399/277, 275
See application file for complete search history.

(56) References Cited

U.S. PATENT DOCUMENTS

| | | | | | |
|---|---|---|---|---|---|
| 4,136,637 | A | * | 1/1979 | Snelling | 399/277 |
| 4,646,677 | A | * | 3/1987 | Lounsbury et al. | |
| 4,836,136 | A | * | 6/1989 | Natsuhara | |
| 4,982,689 | A | * | 1/1991 | Honda et al. | 399/275 |
| 5,105,226 | A | * | 4/1992 | Sugihara | |
| 5,153,376 | A | * | 10/1992 | Tomita | |
| 5,675,893 | A | * | 10/1997 | Yamada et al. | |
| 2002/0078568 | A1 | * | 6/2002 | Maggio et al. | |
| 2009/0060591 | A1 | * | 3/2009 | Kojima et al. | |
| 2009/0311011 | A1 | * | 12/2009 | Hayase et al. | 399/277 |

FOREIGN PATENT DOCUMENTS

| | | | | |
|---|---|---|---|---|
| JP | 05267049 | A | * | 10/1993 |
| JP | 2000-114031 | A | | 4/2000 |
| JP | 2001165148 | A | * | 6/2001 |
| JP | 2006-018061 | | | 1/2006 |
| JP | 2007047396 | A | * | 2/2007 |
| JP | 2010-106963 | | | 5/2010 |

OTHER PUBLICATIONS

Japanese Office Action, Notification of Reason for Refusal, Patent Application No. 2012-259152, Dispatch Date: Oct. 14, 2014 with English translation thereof (total of 5 pages).

* cited by examiner

*Primary Examiner* — Susan Lee
(74) *Attorney, Agent, or Firm* — Lucas & Mercanti, LLP

(57) ABSTRACT

A development roller according to the present invention includes a magnet roller in which a magnet portion generating a magnetic force and a shaft portion projecting from the magnet portion are formed integrally, wherein a recess is provided on an end surface of the magnet portion on a side of the shaft portion.

9 Claims, 15 Drawing Sheets

EVALUATION 1

EVALUATION 2

EVALUATION 4

FIG.10

| RECESS (R SURFACE) DIMENSION [mm] | EVALUATION 1 SHAFT BREAK STRENGTH | EVALUATION 2 INCREASE IN MAGNETIC FORCE AT END PORTION |
|---|---|---|
| 0.2 | △ | × |
| 0.3 | △ | × |
| 0.5 | ○ | ○ |
| 1 | ○ | ○ |
| 1.5 | ○ | ○ |
| 2 | ○ | ○ |
| 3 | ○ | ○ |
| 4 | ○ | ○ |
| 5 | ○ | ○ |
| 6 | ○ | × |
| 7 | ○ | × |

| FLAT SURFACE WIDTH AT END PORTION OF MAGNET PORTION [mm] | EVALUATION 3 INCREASE IN MAGNETIC FORCE AT END PORTION | EVALUATION 4 DURABILITY LIFE |
|---|---|---|
| 0.2 | ○ | × |
| 0.5 | ○ | × |
| 1 | ○ | ○ |
| 1.5 | ○ | ○ |
| 2 | ○ | ○ |
| 3 | ○ | ○ |
| 4 | △ | ○ |
| 5 | △ | ○ |
| 6 | × | ○ |
| 7 | × | ○ |

DEVELOPMENT ROLLER HAVING MAGNETIC ROLLER AND IMAGE FORMING APPARATUS INCLUDING THE DEVELOPMENT ROLLER

CROSS-REFERENCE TO RELATED APPLICATION

This application is based on Japanese Patent Application No. 2012-259152 filed on Nov. 27, 2012, the contents of which are incorporated herein by reference.

BACKGROUND

1. Technical Field

The present invention relates to a development roller and an image forming apparatus including the development roller.

2. Description of Related Art

In general, in an electrophotographic image forming apparatus, toner is supplied to an electrostatic latent image formed on an image carrier to prepare a toner image, and the toner image is transferred to a paper to obtain a recorded image.

As a unit that supplies the toner to the electrostatic latent image, a development roller is used. The development roller includes a development sleeve formed in a cylindrical shape and made of a non-magnetic material, and a magnet roller housed in the development sleeve and forming a magnetic field to cause toner napping to be generated on a surface of the development sleeve.

The magnet roller normally includes a magnet portion forming a magnetic field and a shaft portion adapted to support the magnet portion in the development sleeve.

In such an image forming apparatus, it is important to arrange the magnet roller at an accurate position with respect to the image carrier for achievement of a good recorded image.

To this end is developed the magnet roller in which the magnet portion and the shaft portion are formed integrally with use of an equal material to prevent relative positions of the magnet portion and the shaft portion from being misaligned.

Japanese Patent Application Laid-Open (JP-A) No. 2000-114031 describes such a magnet roller in which the magnet portion and the shaft portion are formed integrally, in which the magnet portion is formed so that end portions thereof may be gradually thinned. The reason for thinning the end portions of the magnet portion in this manner is to weaken magnetic forces generated at the end portions to cause a magnetic force distribution in an axial direction to be uniform (even).

On the other hand, as for a magnetic force distribution in a circumferential direction of the magnet roller, toner napping cannot be generated on the surface of the development sleeve without an intensity variation in the magnetic force.

In a case where the end portions of the magnet portion are thinned even under such circumstances, the magnetic force distribution in the circumferential direction will be broad (a state in which the intensity variation in the magnetic force is not apparent). This causes a problem in which the magnetic force cannot be maximum at a position contacting the image carrier, and in which a good recorded image cannot be obtained.

SUMMARY

The present invention is accomplished by taking such circumstances as mentioned above into consideration thereof, and an object thereof is to provide a development roller in which a magnetic force distribution in a circumferential direction is not broad in a case where a magnet roller in which a magnet portion and a shaft portion are formed integrally is used, and an image forming apparatus including the development roller.

To achieve at least one of the abovementioned objects, a development roller reflecting one aspect of the present invention includes a magnet roller in which a magnet portion generating a magnetic force and a shaft portion projecting from the magnet portion are formed integrally, wherein one or more recesses are provided on an end surface of the magnet portion on a side of the shaft portion.

Also, the end surface desirably has a width as much as 1 mm or more and 5 mm or less in a direction perpendicular to a projecting direction of the shaft portion except at an area of the recess.

Also, the recess is desirably formed by a curved surface.

Also, the recess is desirably formed by a curved surface whose curvature radius is 0.5 mm or more and 5 mm or less.

Also, the recess is desirably formed along an outer circumference of the shaft portion.

Also, the end surface is desirably provided with the plurality of recesses.

Also, the development roller desirably further includes a sleeve covering the magnet roller, wherein the sleeve is desirably rotated around the magnet roller.

Also, to achieve at least one of the abovementioned objects, an image forming apparatus reflecting one aspect of the present invention includes the aforementioned development roller.

The objects, features, and characteristics of this invention other than those set forth above will become apparent from the description given herein below with reference to preferred embodiments illustrated in the accompanying drawings.

BRIEF DESCRIPTION OF THE DRAWINGS

FIG. 10 is a table summarizing various evaluations 1 to 4;

DETAILED DESCRIPTION

Figure 1:
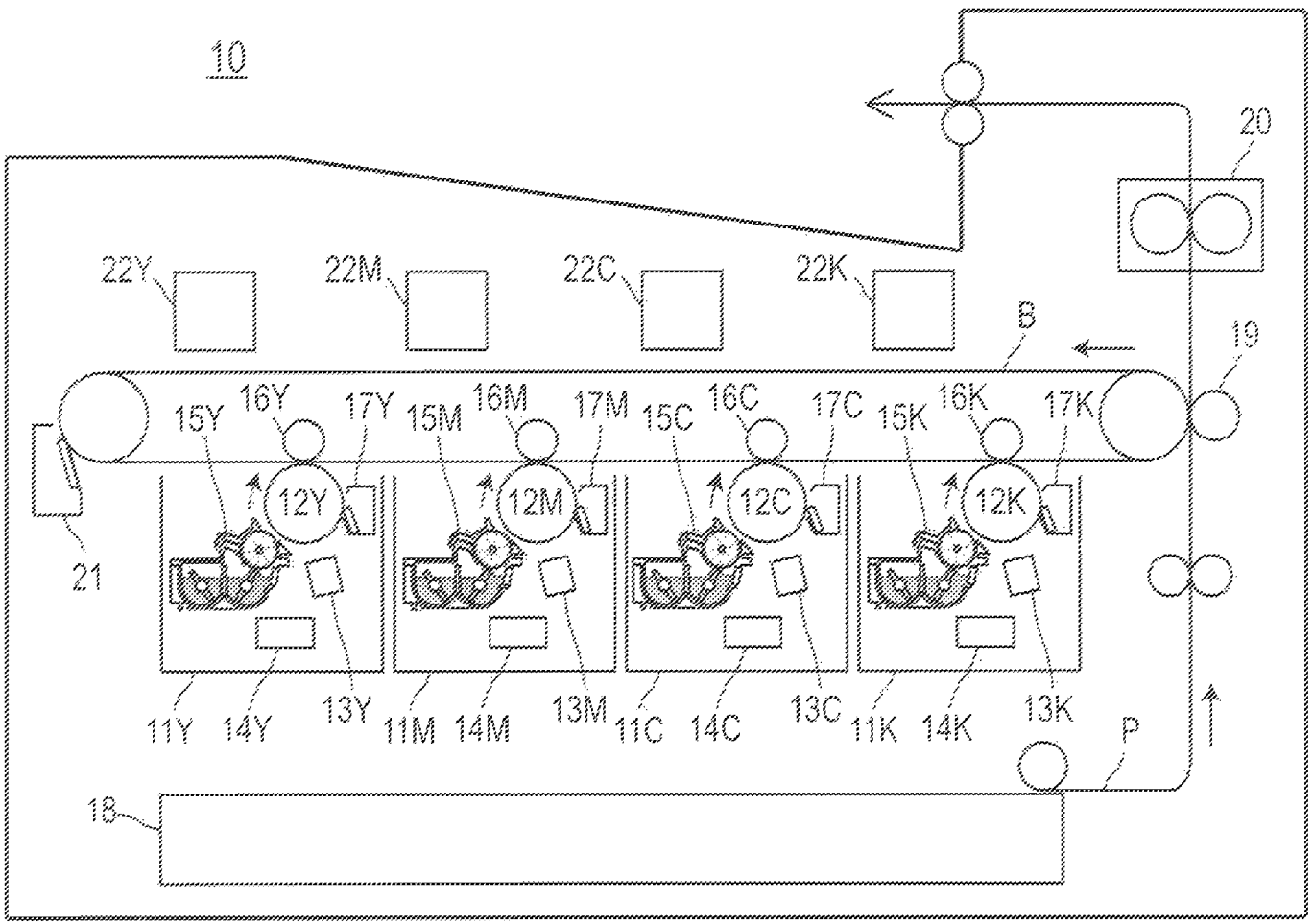
FIG. 1 is a schematic configuration diagram of an image forming apparatus.

The embodiments of this invention will be described below with reference to the accompanying drawings. It is to be noted that, in description of the drawings, identical components are shown with the same reference numerals, and description of the duplicate components is omitted. Also, dimensional ratios in the drawings are exaggerated for convenience of description and may be different from actual ratios.

(Brief Summary of Image Forming Apparatus 10)

FIG. 1 is a schematic configuration diagram of an image forming apparatus 10 according to an embodiment.

The image forming apparatus 10 is an electrophotographic image forming apparatus such as a laser printer. For example, the image forming apparatus 10 is an apparatus of forming a latent image with use of photoconductivity of a solid, electrostatically attaching toner as colored particles to the latent image to form a visible image (hereinafter also referred to as a toner image), and transferring and fixing the visible image to a printing medium to form an image.

The image forming apparatus 10 includes image forming units 11Y, 11M, 11C, and 11K forming toner images of respective colors of yellow (Y), magenta (M), cyan (C), and black (B), for example, as illustrated in FIG. 1. The image forming apparatus 10 is a so-to-speak tandem image forming apparatus in which the image forming units 11Y, 11M, 11C, and 11K of the respective colors are arranged along an intermediate transfer belt B.

Meanwhile, in the following description, Y, M, C, or K is put after each reference numeral in a case where Y, M, C, and K need to be distinguished and is omitted in a case where Y, M, C, and K do not need to be distinguished.

Each image forming unit 11 is configured to include a photosensitive drum 12 and an electrostatic charge unit 13, an exposure unit 14, a development unit 15, a primary transfer unit 16, and a cleaning unit 17 arranged around the photosensitive drum 12.

The photosensitive drum 12 is an image carrier having a photosensitive layer made of a resin such as polycarbonate containing an organic photo conductor (OPC) and is configured to be rotated at predetermined speed.

The electrostatic charge unit 13 includes a corona discharge electrode and charges a surface of the photosensitive drum 12 by generated ions.

The exposure unit 14 incorporates an optical scanning unit and forms an electrostatic latent image by exposing the charged photosensitive drum 12.

The development unit 15 visualizes (develops) the electrostatic latent image formed on the photosensitive drum 12 with use of a two-component developer containing toner and magnetic particles (carrier). That is, the development unit 15 forms a toner image by electrostatically attaching the toner to the photosensitive drum 12. Meanwhile, the magnetic particles function to friction-charge the toner, hold the toner on the surface by an electrostatic attractive force (coulombic force), and carry the toner to a position of the photosensitive drum 12. Detailed description of the development unit 15 will be provided later.

The primary transfer unit 16 transfers the toner image formed on the photosensitive drum 12 to the intermediate transfer belt B.

The cleaning unit 17 scrapes away (removes) residues such as the toner and an external additive remaining on the surface of the photosensitive drum 12 after transfer of the toner image on the intermediate transfer belt B. This enables the surface of the photosensitive drum 12 to be maintained in a favorable state.

Also, the image forming apparatus 10 additionally includes a paper feeding unit 18, a secondary transfer unit 19, a fixing unit 20, a belt cleaning unit 21, and toner hoppers 22 of the respective colors.

The paper feeding unit 18 includes a paper feeding tray housing a paper P, a feed roller, and a separation roller and sends away the paper P one by one from the paper feeding tray to a conveyance path by the feed roller and the separation roller.

The secondary transfer unit 19 transfers the toner images overlapping on the intermediate transfer belt B by the image forming units 11 of the respective colors to the paper P fed from the paper feeding unit 18.

The fixing unit 20 is used to fix a color image transferred on the paper P and includes a not-illustrated heat roller and a not-illustrated pressure roller. The paper P is heated and pressurized at the time of passing between the heat roller and the pressure roller, and the toner is fused, which causes the color image to be fixed.

The belt cleaning unit 21 is a unit of cleaning the intermediate transfer belt B before the toner images of the respective colors are transferred at the respective image forming units 11.

The toner hoppers 22 are containers that store toner of the respective colors.

(Development Unit 15)

Next, the development unit 15 will be described more specifically.

Figure 2:
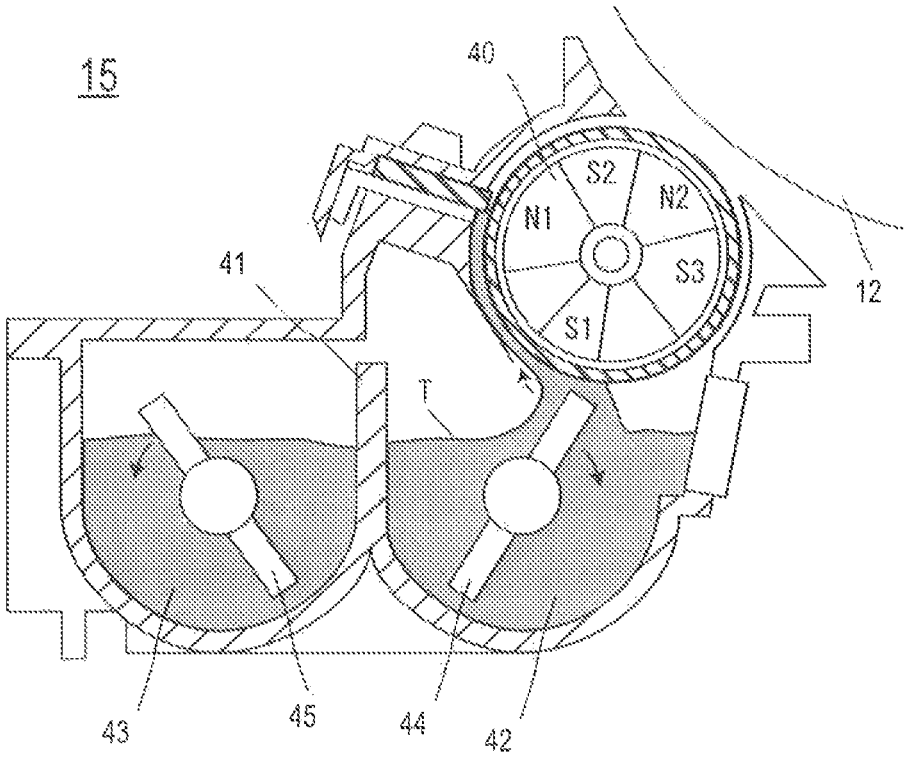
FIG. 2 is a cross-sectional view of a development unit.

FIG. 2 is a cross-sectional view of the development unit 15. As illustrated in FIG. 2, an inside of the development unit 15 is partitioned into a first chamber (development chamber) 42 and a second chamber (agitation chamber) 43 by a partition wall 41.

The first chamber 42 and the second chamber 43 are provided with first and second screws 44 and 45, respectively. The first screw 44 agitates and conveys the developer in the first chamber 42. The second screw 45 agitates and conveys the toner newly supplied from the toner hopper 22 and the developer residing in the development unit 15 to make a toner concentration of the developer uniform. The developer whose toner concentration has been uniform in the second chamber 43 is then supplied to a development roller 40 via the first chamber 42.

In the partition wall 41 between the first chamber 42 and the second chamber 43 are formed developer passages letting the first chamber 42 and the second chamber 43 communicate with each other at end portions on a near side and on a back side in the figure. The developer in the first chamber 42 whose toner concentration has been lowered by consumption of the toner due to development can move to the second chamber 43 through one passage by conveying forces of the first and second screws 44 and 45. The developer whose toner concentration has been recovered in the second chamber 43 can move to the first chamber 42 through the other passage.

(Development Roller 40)

Next, the development roller 40 will be described more specifically with reference to FIGS. 3 to 5.

Figure 3:
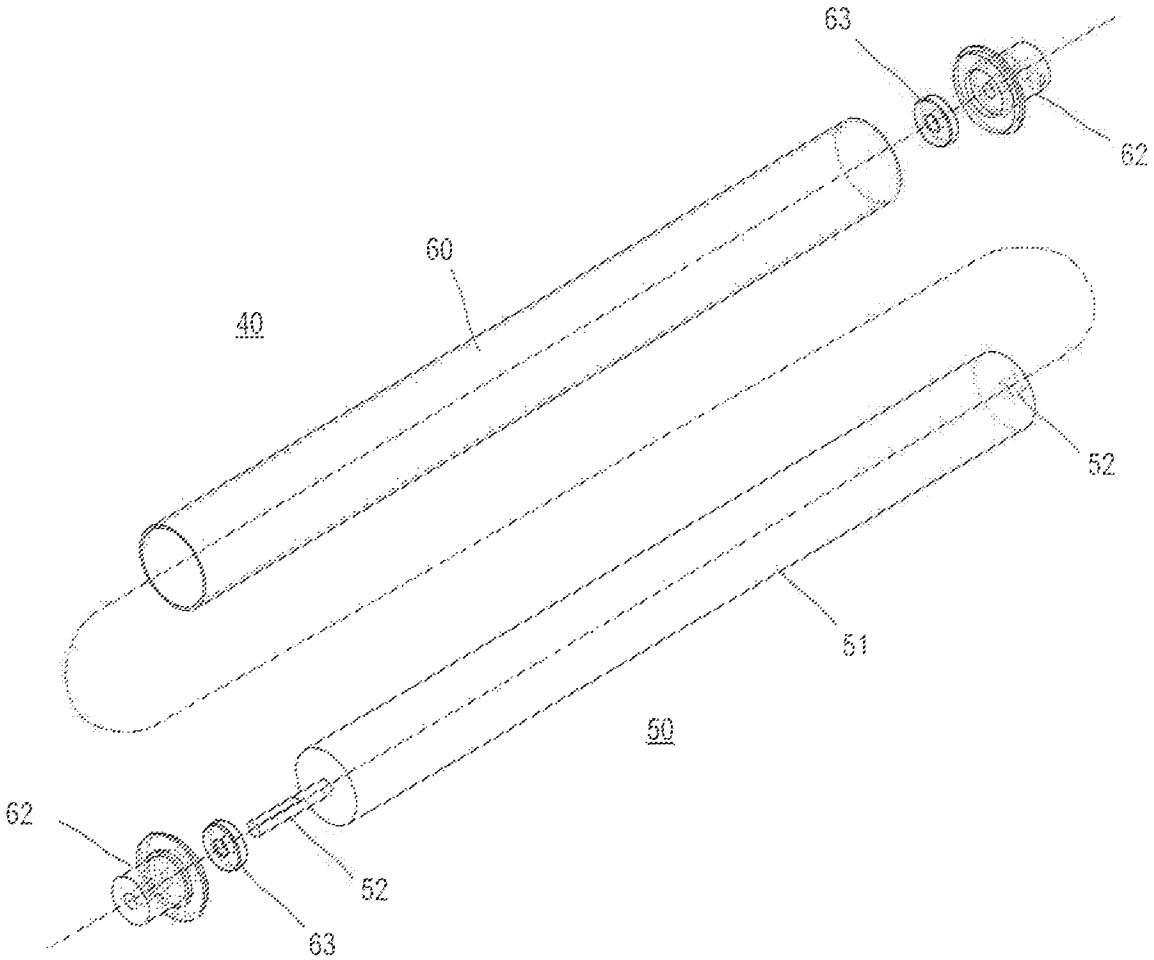
FIG. 3 is an exploded perspective view of a development roller.
Figure 4A:
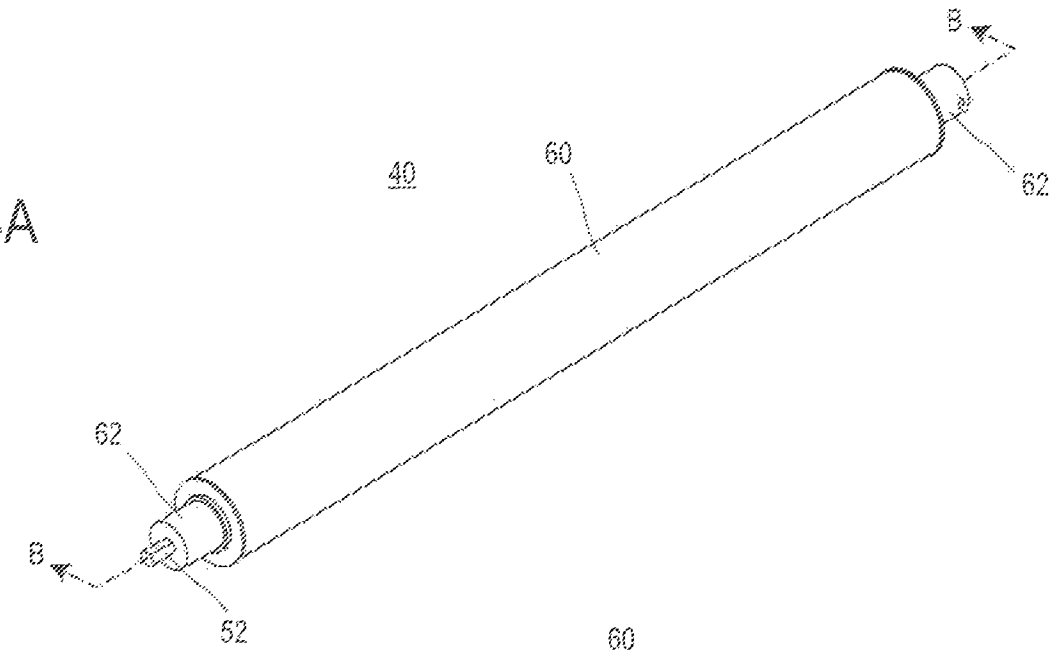
FIG. 4A is a perspective view of the development roller.
Figure 4B:
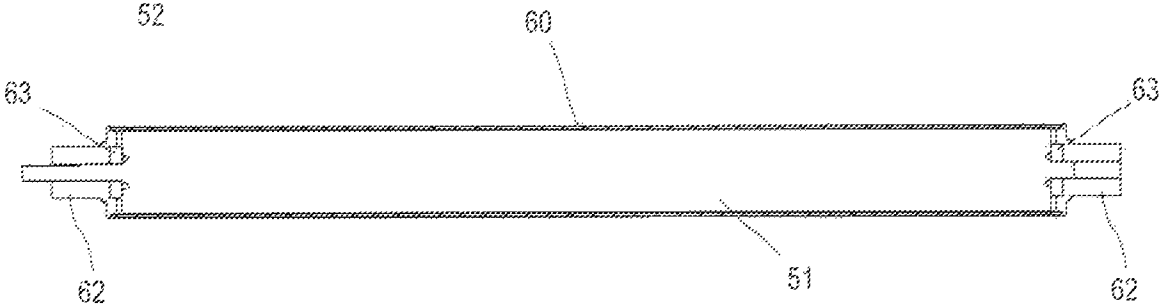
FIG. 4B is a cross-sectional view along the cross-section B-B in FIG. 4A.

FIG. 3 is an exploded perspective view of the development roller 40. FIG. 4A is a perspective view of the development roller 40. FIG. 4B is a cross-sectional view of the development roller 40 along the cross-section B-B in FIG. 4A. FIG. 5 is a view of a magnet roller 50 as seen in an axial direction (front surface) said is an enlarged view of a closest part (aperture part) to the photosensitive drum 12.

The development roller 40 includes the magnet roller 50, a development sleeve 60 housing the magnet roller 50, and two flanges 62 connecting the magnet roller 50 with the development sleeve 60 as illustrated in FIGS. 3, 4A, and 4B.

As for the magnet roller 50, a cylindrical magnet portion (also referred to as "a main body portion") 51 and shaft portions 52 projecting from both ends of the magnet portion 51 are formed integrally with use of an equal magnetic material. For example, the magnetic material is a mixture of magnetic powder and a binder for binding and solidification of the magnetic powder. As the magnetic powder, one out of ferritic, rare-earth (SmCo, NdFeB), MnAlC, alnico, and SmFeN powder can be selected. Also, as the binder, a thermoplastic resin, a thermoset resin, a low-melting-point alloy, or the like can be used.

In the magnet portion 51, the aforementioned magnetic material is oriented. By doing so, a magnetic force that causes toner napping (enlarged view in FIG. 5) to be generated on a surface of the development sleeve 60 is generated from the magnet portion 51.

In general, a magnetic force distribution F in a circumferential direction of the magnet portion 51 is provided with an apparent intensity variation in the magnetic force. That is, in the circumferential direction of the magnet portion 51 are locally provided an area in which a strong magnetic force is generated and an area in which only a weak magnetic force is generated as illustrated in FIG. 5.

Figure 5:
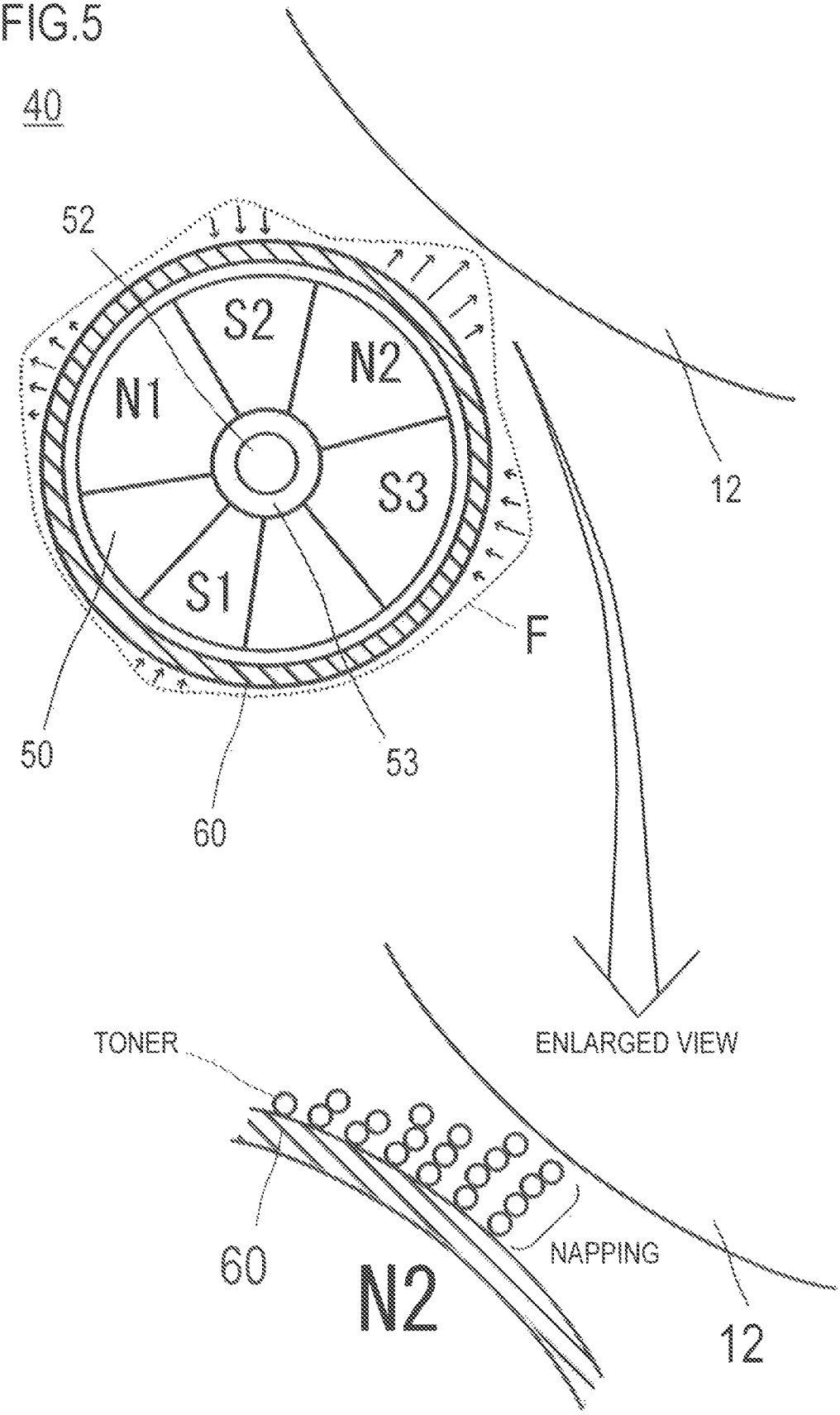
FIG. 5 is a view of a magnet roller as seen in an axial direction (front surface) and is an enlarged view of a closest part (aperture part) to a photosensitive drum.

An area S1 illustrated in FIG. 5 is provided as a pole (draw-up pole) that draws the developer from the first chamber 42 in the development unit 15, in which a magnetic force adapted to attach the developer to the development sleeve 60 acts.

An area N1 is provided as a pole (regulation pole) that partially removes the developer attached to the development sleeve 60 to make the amount of the developer appropriate, in which a magnetic force adapted to remove the developer from the development sleeve 60 is generated.

An area N2 is located closest to the photosensitive drum 12 and is provided as a pole (development pole) that forms relatively significant toner napping on the development sleeve 60, in which a stronger magnetic force than those in other areas is generated.

Areas S2 and S3 are provided as poles that have opposite polarities of that of the area N2 to facilitate more significant toner napping formed in the area N2, in which weaker magnetic forces than that in N2 act.

An area between S1 and S3 is provided as a pole (release pole) that returns the developer whose toner amount has decreased after development to the first chamber 42, in which a magnetic force is hardly generated.

By forming such a magnetic force distribution F in the circumferential direction of the magnet portion 51, the development roller 40 can form relatively significant toner napping at a position (N2) closest to the photosensitive drum 12 while normally functioning as the development roller 40. This facilitates attachment of the toner to the photosensitive drum 12, which enables formation of a good recorded image.

Meanwhile, a magnetic force distribution in the axial direction of the magnet portion 51 (that is, a direction parallel to the dashed line in FIG. 3) is preferably uniform.

Also, in the shaft portions 52, the aforementioned magnetic material is adjusted to be non-oriented. By doing so, no magnetic force is generated from the shaft portions 52. As for each shaft portion 52, a part of a cylindrical outer circumference thereof is cut, at which a flat portion is formed. Inside the flange 62 supporting the shaft portion 52 is provided a shape corresponding to the flat portion, which causes a position of the magnet roller 50 in a rotating direction thereof to be determined unambiguously.

The development sleeve 60 is formed in a cylindrical shape with use of a non-magnetic material, houses the magnet roller 50 inside the cylinder so as to cover the magnet roller 50, and carries the developer on a cylindrical outside surface thereof. The development sleeve 60 is rotated, centering on a center axis (the dashed line in FIG. 3) of the magnet roller 50 and conveys the developer in a direction of the photosensitive drum 12.

The two flanges 62 connect the magnet roller 50 with the development sleeve 60 by sandwiching the magnet roller 50 and the development sleeve 60 from both ends. Inside the respective flanges 62 are provided slide bearings 63, which causes a position of the magnet roller 50 in the axial direction thereof to be determined unambiguously.

In this manner, the magnet roller 50 is positioned in the rotating direction and the axial direction, and allows the development sleeve 60 to be rotated therearound in a state in which the magnet roller 50 is not rotated.

In the above manner, the development roller 40 is assembled with use of the magnet roller 50, the development sleeve 60, the flanges 62, and the slide bearings 63, and the development roller 40 as illustrated in FIGS. 4A and 4B is formed.

(Details of Magnet Roller 50)

Next, the aforementioned magnet roller 50 will be described in details.

Figure 6:
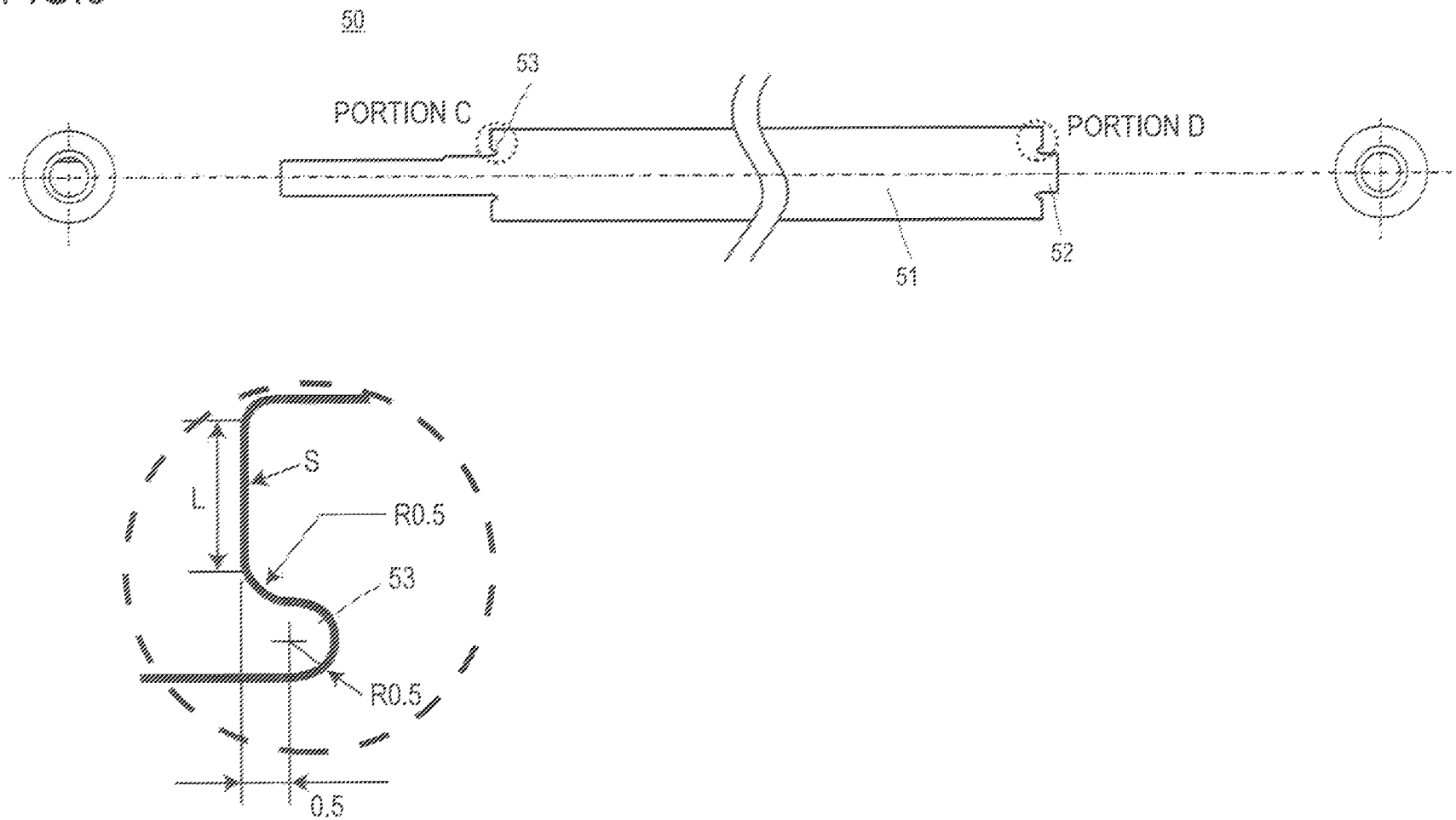
FIG. 6 is a front view, a cross-sectional view, and a back view of the magnet roller and a detail view of a portion C and a portion D.

FIG. 6 is a front view, a cross-sectional view, and a back view of the magnet roller 50 and a detail view of a portion C and a portion D.

As illustrated in FIG. 6, the portion C and the portion D of the magnet roller 50 are provided with recesses 53. That is, end surfaces (hereinafter referred to as "end surfaces S") on sides of the shaft portions 52 of the magnet roller 50 are provided with the recesses 53.

As is apparent from the detail view of the portion C and the portion D, the recess 53 provided on the end surface S is formed by a curved surface (P surface) whose curvature radius is 0.5 mm, for example. The recess 53 formed in such a shape is formed over the whole circumference along the outer circumference of the shaft portion 52 as illustrated in FIG. 5 as well.

Also, the end surface S has a 2-mm width L in a direction perpendicular to a projecting direction (that is, the axial direction) of the shaft portion 52 except at an area of the recess 53.

In the above manner, the image forming apparatus 10 according to the present embodiment includes the magnet roller 50 in which the magnet portion 51 and the shaft portions 52 are formed integrally, and the end surface S of the magnet roller 50 is provided with the recess 53. This enables a magnetic force generated at the end portion of the magnet portion 51 to be weakened. As a result, an increase in the magnetic force at the end portion of the magnet portion 51 is restricted, and the magnetic force distribution in the axial direction becomes uniform.

Additionally, since the end portions of the magnet portion 51 are not formed to be gradually thinned, the magnetic force distribution F in the circumferential direction will not be broad (a state in which the intensity variation in the magnetic force is not apparent).

Also, by providing the end surface S with the recess 53, a break strength of the shaft portion 52 increases. The reason for this is that stress to be applied to a boundary part of the magnet portion 51 and the shaft portion 52 does not concentrate on a point but is dispersed over the curved surface of the recess 53.

Also, by providing the end surface S with the flat portion with the width L as described above, contact between the magnet portion 51 and the slide bearing 63 is not point contact but surface contact (contact between the end surface S and one surface of the slide bearing 63). This can prevent abrasion of the slide bearing 63 and the magnet portion 51 and improves durability.

Hereinafter, results of various evaluations performed for the magnet roller 50 will be described.

(Break Strength "Evaluation 1")

First, for the magnet roller 50 according to the present embodiment, the break strength of the shaft portion 52 was measured by varying a dimension of the recess 53 provided in the magnet portion 51.

Figure 7:
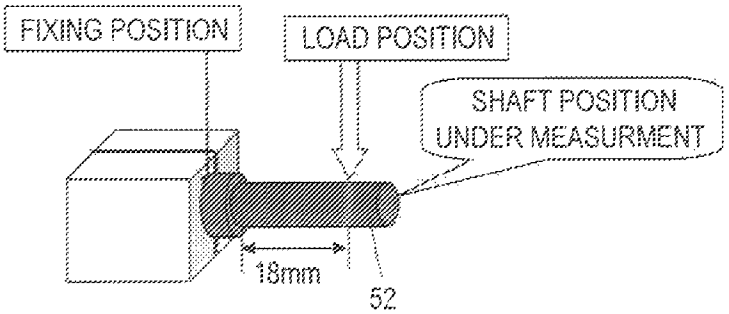
FIG. 7 is a view illustrating a method for measuring a break strength for the magnet roller and a graph illustrating a measurement result thereof.
Figure 7:
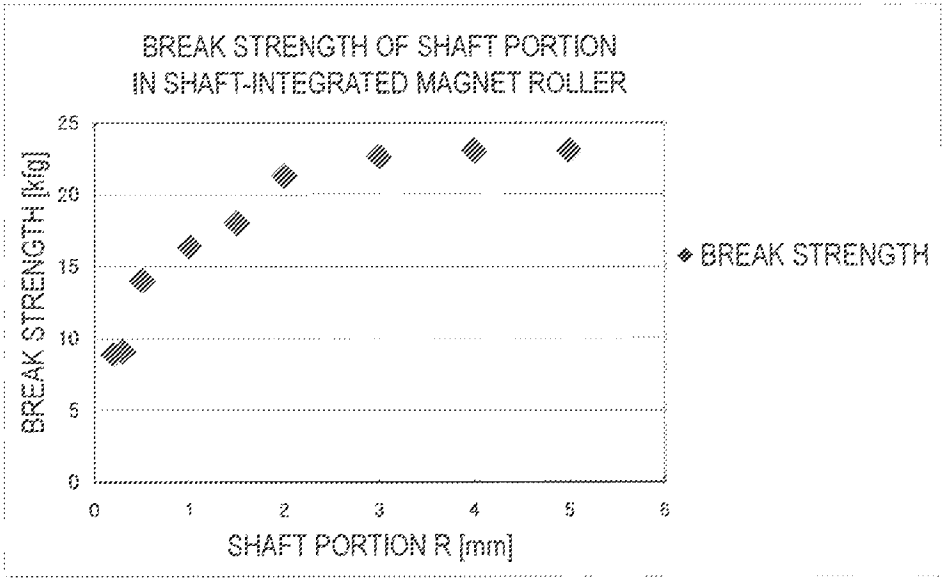

FIG. 7 is a view illustrating a method for measuring the break strength for the magnet roller 50 and a graph illustrating a measurement result thereof.

The break strength of the shaft portion 52 was measured as illustrated in the left view in FIG. 7. That is, in a state in which a root ("fixing position" in the figure) of the shaft portion 52 was fixed, a force was applied to a position ("load position" in the figure) 18 mm away from the fixing position. The force (load force) to be applied to the load position was gradually strengthened, and the load force when the shaft portion 52 was broken was recorded. Such recording was repeatedly carried out by varying the curvature radius of the recess 53 provided in the magnet portion 51.

The right graph in FIG. 7 illustrates a measurement result thereof. The horizontal axis represents the curvature radius [mm] of the recess 53 while the vertical axis represents the load force (break strength [kgf]) when the shaft portion 52 is broken. As illustrated in the right graph in FIG. 7, the break strength of the shaft portion 52 increases along with an increase in the curvature radius of the recess 53. It has been found from this measurement result that setting the curvature radius of the recess 53 to 0.5 [mm] or more, for example, can bring about obtainment of the magnet roller 50 with a standard or higher break strength.

(Increase in Magnetic Force at End Portion "Evaluation 2")

Next, for the magnet roller 50 according to the present embodiment, the magnetic force distributions in the axial direction of the magnet roller 50 were compared by varying the dimension of the recess 53 provided in the magnet portion 51.

Figure 8:
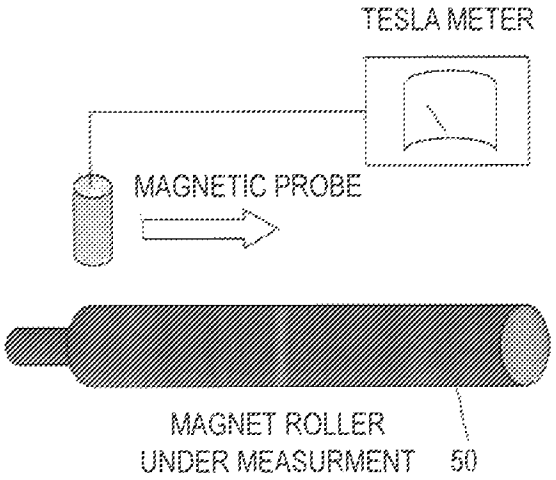
FIG. 8 is a view illustrating a method for measuring a magnetic force of the magnet roller and a graph illustrating a measurement result thereof.
Figure 8:
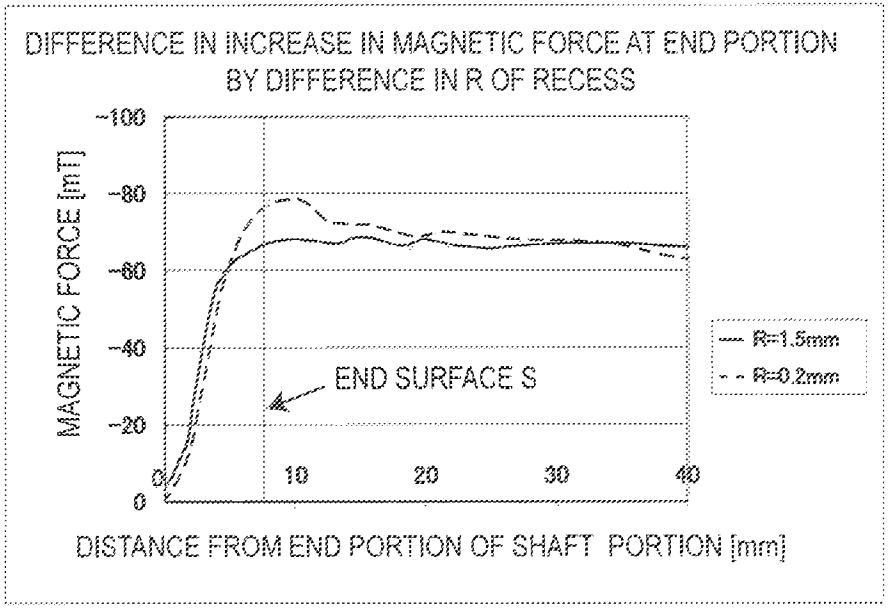

FIG. 8 is a view illustrating a method for measuring the magnetic force of the magnet roller 50 and a graph illustrating a measurement result thereof.

The magnetic force of the magnet roller 50 was measured as illustrated in the left view in FIG. 8. That is, measurement values when a magnetic probe was moved in parallel from the left end to the right end of the magnet roller 50 in the figure in a state in which the magnetic probe was put close to the surface of the magnet roller 50 were measured. Such recording was repeatedly carried out by varying the curvature radius of the recess 53 provided in the magnet portion 51.

The right graph in FIG. 8 illustrates a measurement result thereof. The horizontal axis represents a distance (position of the magnetic probe) [mm] from the left end of the magnet roller 50 while the vertical axis represents the measured magnetic force [mT]. The solid line graph represents the magnetic force distribution when the curvature radius of the recess 53 is 1.5 [mm] while the dashed line graph represents the magnetic force distribution when the curvature radius of the recess 53 is 0.2 [mm]. As illustrated in the right graph in FIG. 8, when the curvature radius of the recess 53 is 0.2 [mm], an increase in the magnetic force is generated around the end surface S of the magnet portion 51. On the other hand, when the curvature radius of the recess 53 is 1.5 [mm], no increase in the magnetic force is generated around the end surface S of the magnet portion 51. It has been found from this measurement result that setting the curvature radius of the recess 53 to 0.5 [mm] or more and 5 [mm] or less, for example, can cause the magnetic force distribution in the axial direction to be uniform.

(Increase in Magnetic Force at End Portion "Evaluation 3")

Next, for the magnet roller 50 according to the present embodiment, the magnetic force distributions in the axial direction of the magnet roller 50 were compared by varying the width L of the end surface S of the magnet portion 51.

Although a method for measuring the magnetic force of the magnet roller 50 is not illustrated, measurement values when a magnetic probe was moved in parallel from the left end to the right end of the magnet roller 50 in a state in which the magnetic probe was put close to the surface of the magnet roller 50 were measured. Such recording was repeatedly carried out by varying the width L of the end surface S of the magnet portion 51. As a result, it has been found that setting the width L of the end surface S to 3 [mm] or less, for example, can cause the magnetic force distribution in the axial direction to be uniform.

(Durability Life "Evaluation 4")

Next, for the magnet roller 50 according to the present embodiment, durability lives of the magnet roller 50 were compared by varying the width L of the end surface S of the magnet portion 51.

Figure 9:
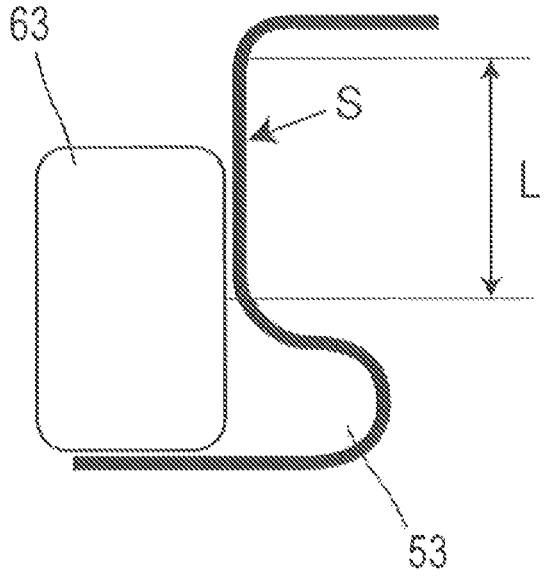
FIG. 9 describes a contacting part between the magnet roller and a bearing member.

FIG. 9 corresponds to the detail view in FIG. 6 and describes a contacting part between the magnet roller 50 and the bearing member (slide bearing 63).

In a state in which the end surface S of the magnet portion 51 and the slide bearing 63 were brought into surface contact with each other as illustrated in FIG. 9, the development sleeve 60 was rotated to satisfy predetermined conditions (rotation count, rotation speed), for example. This operation was repeated by varying the width L of the end surface S to compare abrasion states of the magnet portion 51 and the slide bearing 63.

As a result, it has been found that setting the width L of the end surface S to 1 [mm] or more, for example, can bring about obtainment of the magnet roller 50 with standard or higher durability.

FIG. 10 is a table summarizing the above evaluations. As illustrated in the figure, setting the curvature radius of the recess 53 provided in the magnet portion 51 to 0.5 [mm] or more and 5 [mm] or less causes the break strength of the shaft portion 52 to be high and prevents generation of the increase in the magnetic force at the end portion. Also, setting the width L of the end surface S of the magnet portion 51 to 1 [mm] or more and 3 [mm] or less prevents generation of the increase in the magnetic force at the end portion and provides a long durability life.

Modification Examples

The aforementioned embodiment is intended to illustrate the scope of the present invention and does not limit the present invention. Many alternatives, alterations, and modification examples are apparent to those skilled in the art.

For example, a shape of the recess 53 to be formed on the end surface S of the magnet portion 51 is not limited to one in the above embodiment and can be modified in various manners.

FIGS. 11A to 11E illustrate modification examples of the recess 53 in parts corresponding to the enlarged view in FIG. 6.

Figure 11A:
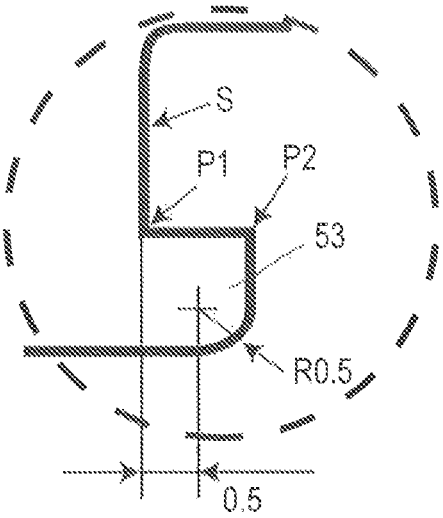
FIGS. 11A to 11E illustrate modification examples of a recess in parts corresponding to the detail view in FIG. 6.

As illustrated in FIG. 11A, as for the recess 53 of the above embodiment, a part P1 (outer edge portion) and a part P2 (outer deepest portion) may be formed not to be curved.

Figure 11D:
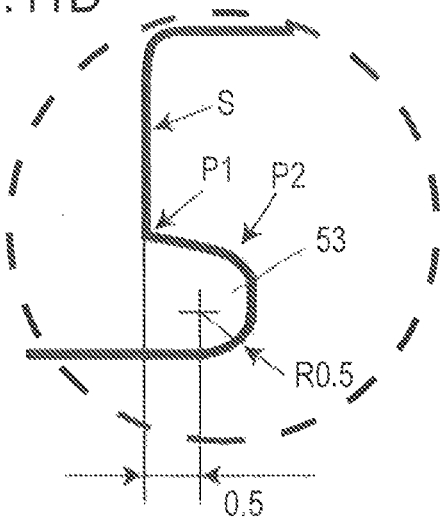
Figure 11B:
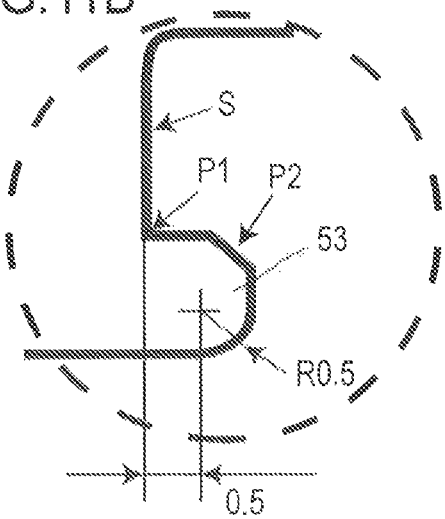

Also, as illustrated in FIG. 11B, as for the recess 53 in FIG. 11A, the part P2 may be sloped.

Figure 11E:
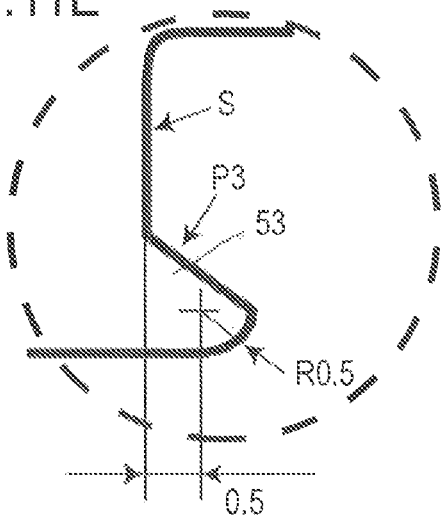
Figure 11C:
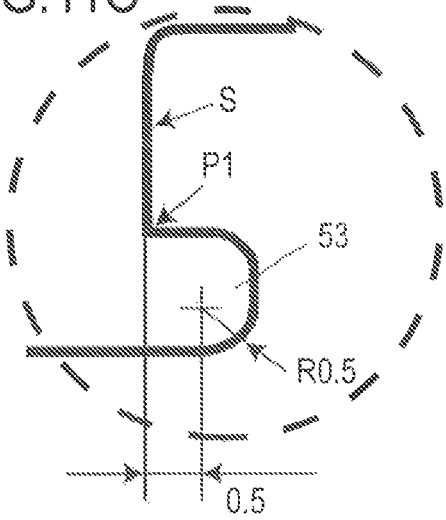

Also, as illustrated in FIG. 11C, as for the recess 53 of the above embodiment (enlarged view in FIG. 6), only the part P1 may be formed not to be curved.

Also, as illustrated in FIG. 11D, as for the recess 53 in FIG. 11C, the curvature radius of the part P2 may be enlarged.

Also, as illustrated in FIG. 11E, as for the recess 53 in FIG. 11D, an entirety of a part P3 (outer side) may be sloped.

FIGS. 12A, 12B, 13A, 13B, 14A, and 14B illustrate modification examples of the recess 53 in parts corresponding to FIG. 5.

Figure 12A:
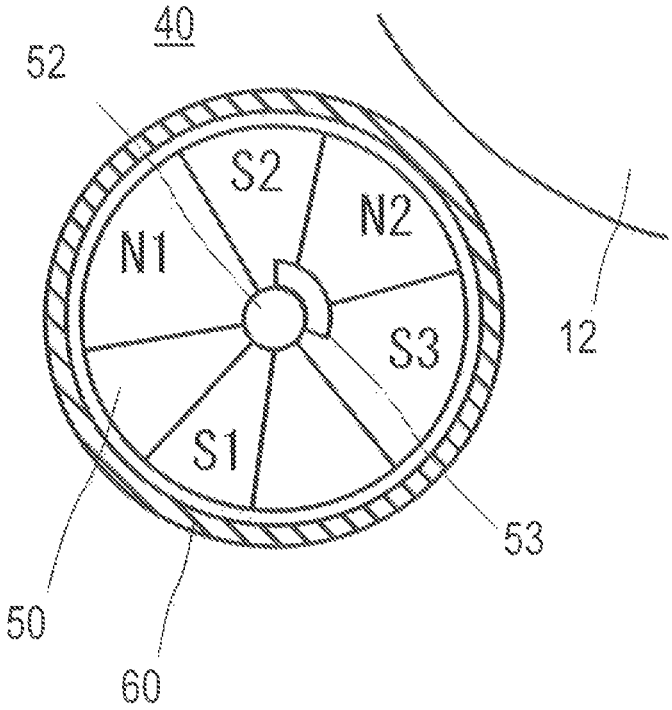
FIGS. 12A and 12B illustrate modification examples of the recess in parts corresponding to FIG. 5.

In the above embodiment, the recess 53 is formed over the whole circumference along the outer circumference of the shaft portion 52 (FIG. 5). However, the present invention is not limited to this, and as illustrated in FIG. 12A, the recess 53 may be selectively provided only at a part around the development pole (N2) along the outer circumference of the shaft portion 52. This eliminates excessive developer at the end portions of the magnet roller 50 at the aperture part of the development unit 15. As a result, it is possible to prevent concentration non-uniformity from being generated in a recorded image to be formed and to restrict scattering of the developer.

Figure 12B:
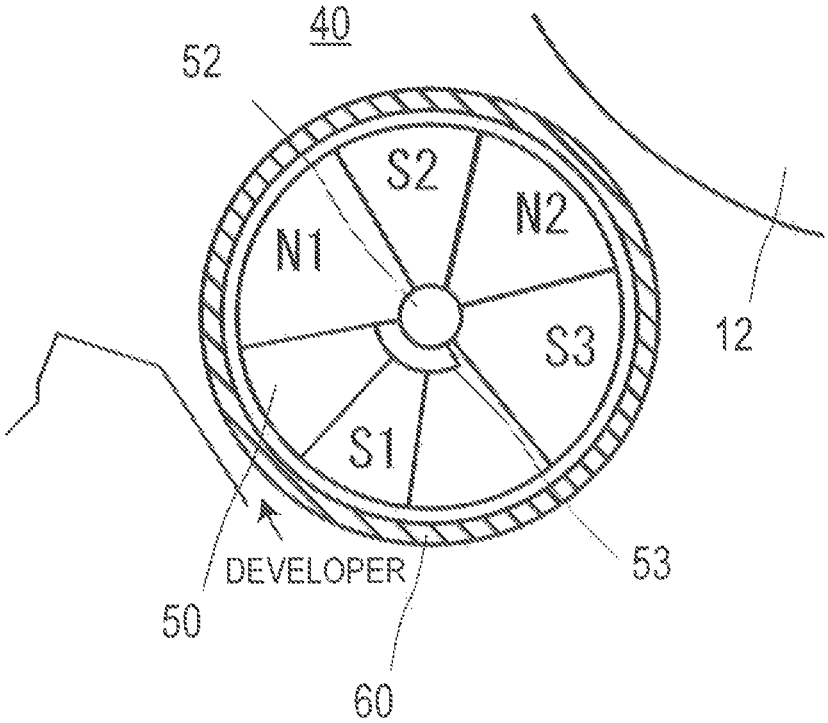

Also, as illustrated in FIG. 12B, the recess 53 may be selectively provided only at a part around the draw-up pole (S1) along the eater circumference of the shaft portion 52. By doing so, the developer can be supplied uniformly over the whole width of the development sleeve 60. Thus, it is possible to prevent concentration non-uniformity from being generated in a recorded image to be formed and to restrict leakage and scattering of the developer from the end portion sides of the magnet roller 50.

Figure 13A:
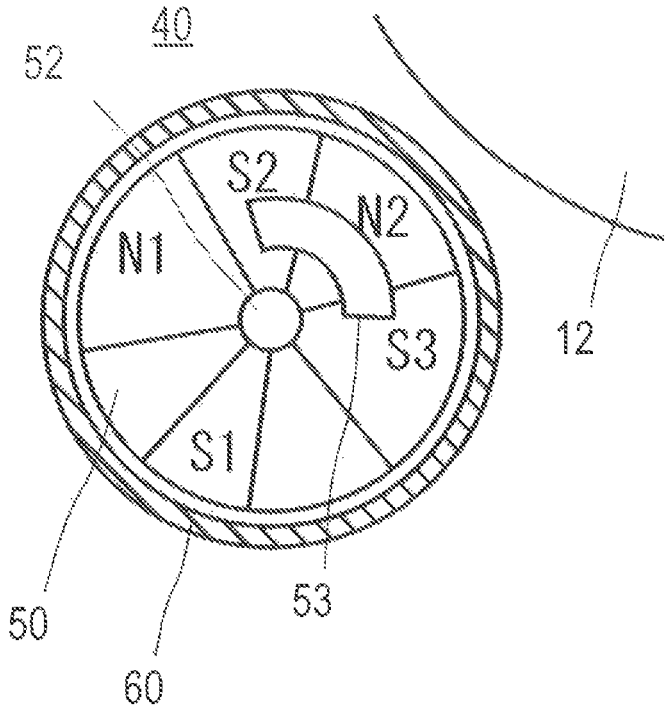
FIGS. 13A and 13B illustrate modification examples of the recess in parts corresponding to FIG. 5.

Also, although the recess 53 is provided at a position just proximal to the outer circumference of the shaft portion 52 in FIG. 12A, the recess 53 may be provided at a position away from the outer circumference of the shaft portion 52 as illustrated in FIG. 13A.

Figure 13B:
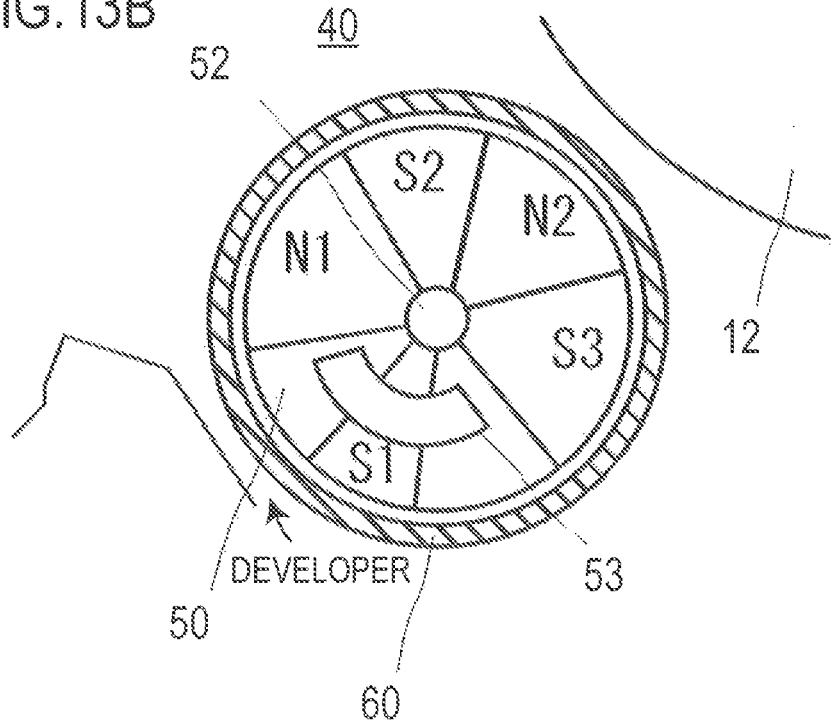

Similarly, the recess 53 in FIG. 12B may also be provided at a position away from the outer circumference of the shaft portion 52 as illustrated in FIG. 13B.

Also, although only one recess 53 is provided on the end surface S in the above embodiment and respective modification examples, a plurality of recesses 53 may be provided.

Figure 14A:
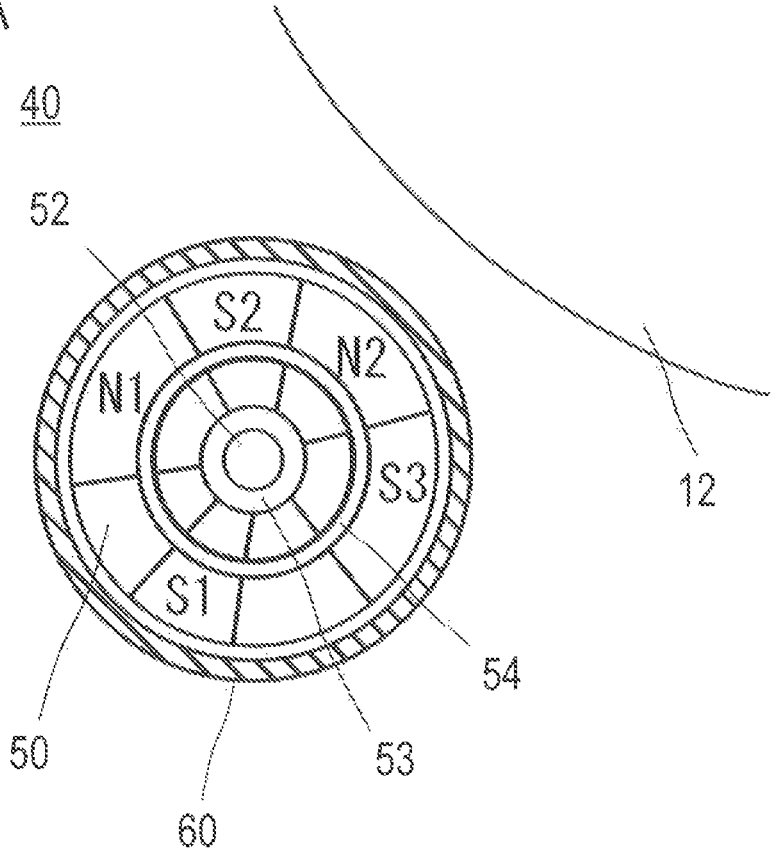
FIG. 14A illustrates a modification example of the recess in a part corresponding to FIG. 5.

For example, as illustrated in FIG. 14A, the first recess 53 close to the shaft portion 52 and a second recess 54 away from the shaft portion 52 may be formed over the whole circumference.

In this case, depths and shapes of the first recess 53 and the second recess 54 may differ.

Figure 14B:
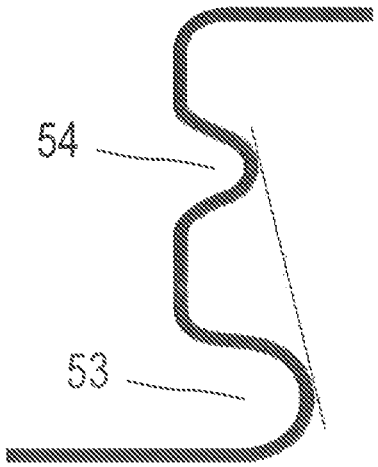
FIG. 14B illustrates depths of respective recesses in FIG. 14A.

FIG. 14B illustrates depths of the first recess 53 and the second recess 54 in FIG. 14A. For example, as illustrated in FIG. 14B, the depth of the first recess 53 may be larger than the depth of the second recess 54.

Also, the magnet roller 50 in the above embodiment and respective modification examples may be utilized not only in the development roller 40 but in various rollers such as a cleaning roller and a conveying roller and in other applications.

Also, in the above embodiment and respective modification examples, the development unit 15 including the single development roller 40 is described. However, the present invention is not limited to this, and the development unit 15 may include a plurality of development rollers 40.

(Molding Method)

Next, a method for molding the magnet roller 50 will be described with reference to FIGS. 15A and 15B.

Figure 15A:
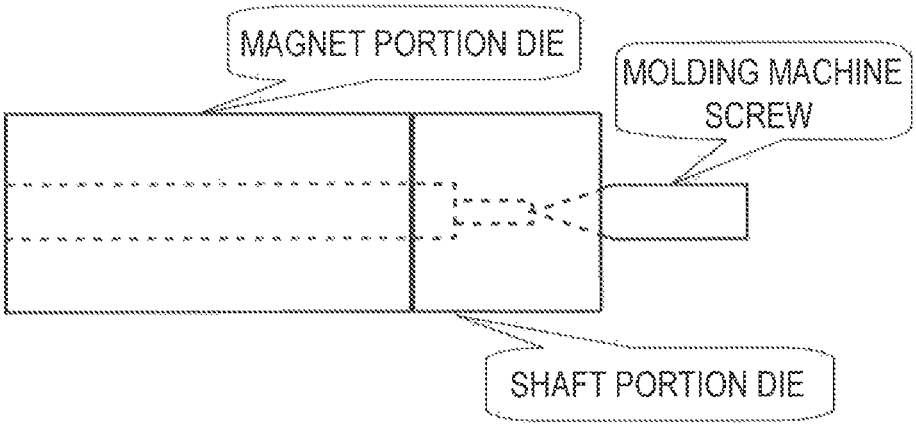
FIG. 15A illustrates a state of dies at the time of molding the magnet roller.
Figure 15B:
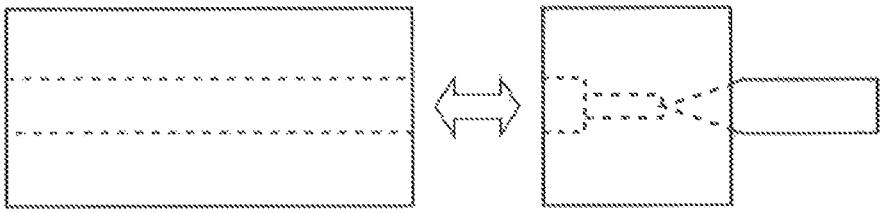
FIG. 15B illustrates a state of the dies after molding the magnet roller.

FIG. 15A illustrates a state of dies at the time of molding the magnet roller 50, and FIG. 15B illustrates a state of the dies after molding the magnet roller 50.

As illustrated in FIGS. 15A and 15B, the magnet roller 50 is molded with use of a movable die magnet portion die), an immovable die (shaft portion die), and a molding machine screw.

For example, molding of the magnet roller 50 is performed in the following procedures.

A1) The cylindrical magnet portion die and shaft portion die are clamped to form a molding space illustrated with the dashed line in the figure.

A2) The aforementioned magnetic material is injected into the molding space by the molding machine screw, and the filled magnetic material is cooled and hardened.

A3) The magnet portion die is opened against the shaft portion die while a molded body (magnet roller 50) made by cooling and hardening is held integrally to release the shaft portion 52 from the shaft portion die.

A4) A not-shown ejection pin is inserted into the molding space from one end of the magnet portion die, the molded body in the magnet portion die is extruded by a predetermined length in a longitudinal direction (axial direction), and the extruded molded body is grasped by a robot arm or the like.

A5) The magnet portion die is pulled to the left side in the figure from the molded body while the grasping state of the molded body by the robot arm is kept to release the entire molded body from the magnet portion die.

By carrying out the above A1 to A5, the magnet roller 50 is molded.

At the time of molding, different magnetic fields by location in the circumferential direction of the molded space are applied to the magnetic material in the magnet portion die. By doing so, as illustrated in FIG. 5, the apparent intensity variation in the magnetic force is provided in the magnetic force distribution F in the circumferential direction generated from the completed magnet portion 51 (FIG. 5).

As described above, with the embodiment and modification examples, even in a case where the magnet roller in which the magnet portion and the shaft portions are formed integrally is used, the development roller whose magnetic force distribution in the circumferential direction is not broad and the image forming apparatus including the development roller can be provided.

The entire disclosure of Japanese Patent Application No. 2012-259152 filed on Nov. 27, 2012 including specification, claims, drawings and summary are incorporated herein by reference in its entirety.

What is claimed is:

1. A development roller comprising:

a magnet roller in which a magnet portion generating a magnetic force and a shaft portion projecting from the magnet portion are formed integrally, wherein a first recess provided on an end surface of the magnet portion on a side of the shaft portion, and wherein the first recess extends circumferentially along an outer circumference of the shaft portion.

2. The development roller as claimed in claim 1, wherein the first recess has by a curved surface, a cross-section of the curved surface along a longitudinal axis of the magnet roller having a curvature.

3. The development roller as claimed in claim 2, wherein the curved surface exhibits a curvature radius of 0.5 mm or more and 5 mm or less in the cross-section of the magnet roller.

4. The development roller as claimed in claim 1, wherein the end surface is provided with a plurality of recesses.

5. The development roller as claimed in claim 4, wherein the first recess is proximate the shaft portion and a second recess on the end surface is distal from the shaft portion, the first recess and the second recess each being formed over the whole circumference.

6. The development roller as claimed in claim 1, further comprising a sleeve covering the magnet roller, wherein the sleeve is rotated around the magnet roller.

7. An image forming apparatus comprising the development roller as claimed in claim 1.

8. The development roller as claimed in claim 1, wherein the magnet portion has a number of magnetic poles and the recess is provided only at a part of a circumference around one of the magnetic poles.

9. A development roller comprising:

a magnet roller in which a magnet portion generating a magnetic force and a shaft portion projecting from the magnet portion are formed integrally, wherein one or more recesses are provided on an end surface of the magnet portion on a side of the shaft portion, and wherein the end surface has a width as much as 1 mm or more and 5 mm or less in a direction perpendicular to a projecting direction of the shaft portion except at an area of the recess.

* * * * *